US005199734A

United States Patent [19]

Mayr

[11] Patent Number: 5,199,734

[45] Date of Patent: * Apr. 6, 1993

[54] SKI

[75] Inventor: Bernhard Mayr, Hard, Austria

[73] Assignee: Head Sportgeräte Gesellschaft m.b.H. & Co. OHG, Wuhrkopfweg, Austria

[ * ] Notice: The portion of the term of this patent subsequent to Sep. 1, 2009 has been disclaimed.

[21] Appl. No.: 680,145

[22] Filed: Apr. 3, 1991

[30] Foreign Application Priority Data

Apr. 5, 1990 [AT] Austria ..... 820/90
Sep. 17, 1990 [AT] Austria ..... 1888/90

[51] Int. Cl.[5] ..... A63C 5/07

[52] U.S. Cl. ..... 280/602; 280/607; 280/617

[58] Field of Search ..... 280/602, 607, 610, 609, 280/617, 618, 601, 634

[56] References Cited

U.S. PATENT DOCUMENTS

| | | | |
|---|---|---|---|
| 2,318,184 | 5/1943 | Rojas | 280/610 |
| 3,260,532 | 7/1966 | Heuvel | 280/11.13 |
| 4,409,287 | 10/1983 | Harrison | 280/601 |
| 4,808,786 | 7/1989 | Mankau | 280/602 |
| 4,995,630 | 2/1991 | Piegay | 280/602 |

FOREIGN PATENT DOCUMENTS

| | | | |
|---|---|---|---|
| 389643 | 6/1989 | Austria . | |
| 37145 | 7/1989 | Austria . | |
| WO83/03360 | 10/1983 | European Pat. Off. . | |
| 2259375 | 6/1974 | Fed. Rep. of Germany . | |
| 2461461 | 7/1976 | Fed. Rep. of Germany | 280/610 |
| 2601951 | 7/1977 | Fed. Rep. of Germany . | |
| 2634748 | 2/1978 | Fed. Rep. of Germany . | |
| 3315638 | 12/1983 | Fed. Rep. of Germany . | |

*Primary Examiner*—Eric D. Culbreth
*Attorney, Agent, or Firm*—Nixon & Vanderhye

[57] ABSTRACT

In a ski (1) with a damping element (5) for damping shocks that act transversely to the longitudinal direction of the ski in the area of the ski binding, with a carrier body (3) for at least one layer of damping material (5), in particular elastomer damping material, which is arranged between the carrier body (3) and the ski (1) the carrier body (3) is connected directly to the upper chord (7) of the ski in a middle area (4) that is located between the front and rear ends, as viewed in the longitudinal direction of the ski, and is connected to the upper side of the ski (1) in front of and behind the middle area (4) through an interposed layer of damping material (5).

20 Claims, 3 Drawing Sheets

SKI

Figure 1:
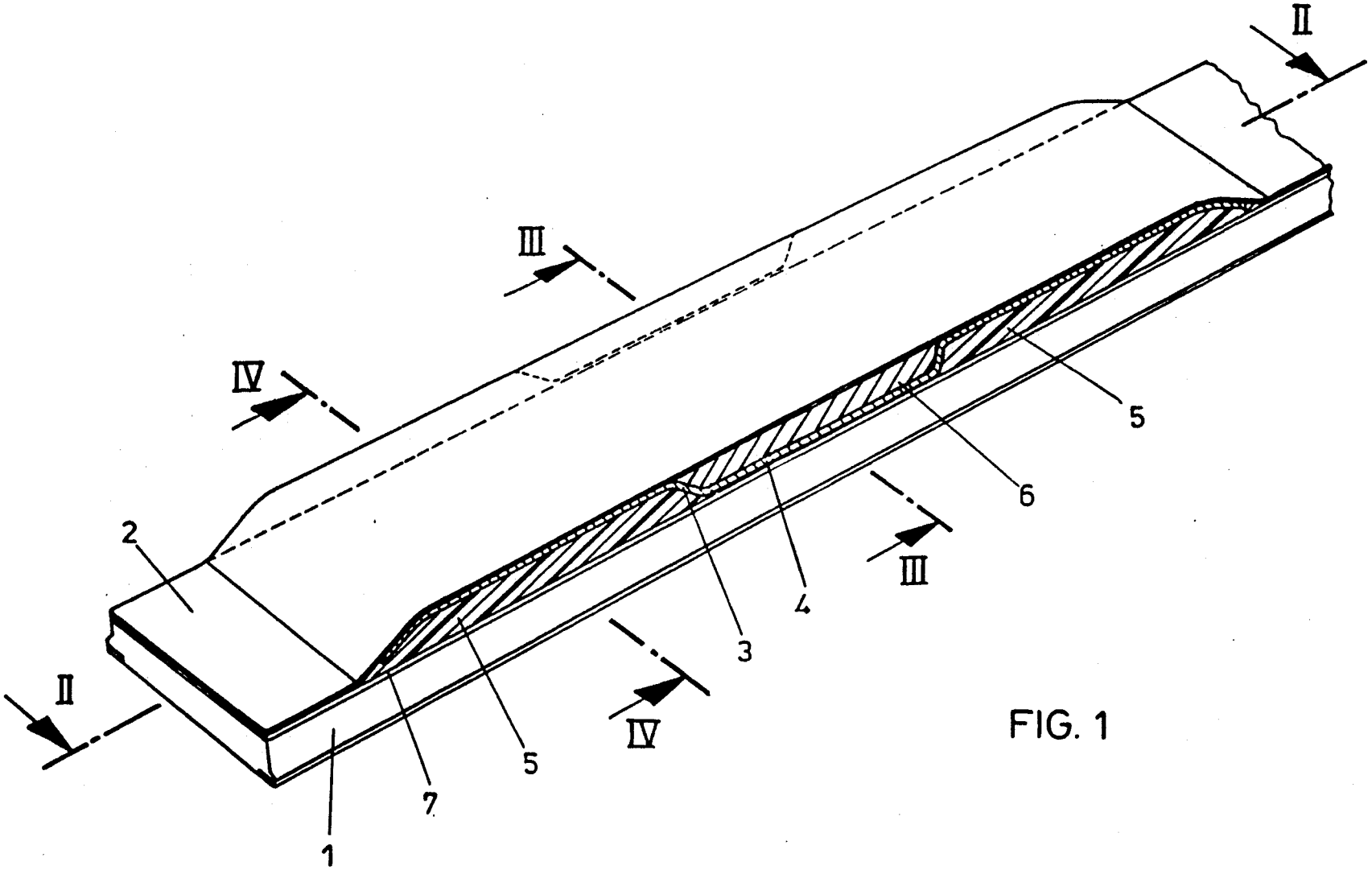

The present invention relates to a ski that incorporates a damping element to damp out shocks that act transversely to the longitudinal direction of the ski, in the area of the ski binding, and with a carrier body for at least one layer of damping material that is arranged between the carrier body and the ski, said damping material being, in particular, an elastomer.

EP-A-104 185 describes a damping element for a ski which can be attached to the upper side of the ski and is intended to permit damping in the longitudinal direction of the ski. To this end, a metallic carrier plate is secured to the upper side at both of its ends by means of screws, through an interposed layer of an elastomer, in which connection at at least one end this attachment must be such as to permit longitudinal displacement in order to prevent the screwed connections shearing off when the ski flexes. Quite apart from the costs involved in mounting damping elements of this sort, a damping effect transverse to the longitudinal direction, i.e., in a direction that is essentially perpendicular to the surface of the ski, is not intended with a configuration of this sort and is only achieved to a limited extent.

The bending behaviour of the ski is effected by damping in the longitudinal direction of the ski. With regard to the sliding connection of a damping element of this kind with the surface of the ski, no noteworthy effect on the torsional characteristics can be achieved without further measures.

DE-OS 26 34 748 and DE-OS 26 01 951 describe springing arrangements in the area of the ski binding of a ski, in which a springboard that can pivot transversely to the lateral direction of the ski is used. The object of a springing arrangement of this kind is to make it easier for the skier to change direction, in which connection of a spring or sprung board will only provide an unsatisfactory damping effect.

In addition, plate-shaped elements that permit a specific degree of adjustability because of their inclination transversely to the longitudinal direction of the ski have also been proposed in order to improve the degree of control which can be exerted by the skier. Of course, configurations of this kind have no effect on the torsional characteristics of a ski and are intended to reduce the danger of the ski tilting.

The present invention is aimed at so improving a ski of the type described in the introduction hereto as to ensure the damping of vertical blows transversely to the longitudinal axis of a ski and, simultaneously, to permit adjustment of the torsional behavior of the ski within wide limits. In addition, the configuration according to the present invention is intended to permit the simplest and safest possible connection of a damping element of this kind to the ski such that it reliably prevents separation of the damping element from the ski even if it is subjected to hard blows and flexing of the ski. The configuration according to the present invention solves this task essentially in that the carrier body is connected rigidly with the upper chord of the ski in a central area that lies between its front and rear ends in the longitudinal direction of the ski and is connected to the upper chord of the ski in front of and behind the center area through interposed damping material. Because of the fact that the attachment of a damping element of this kind is effected in the central area between the front and rear area that lies in the longitudinal direction of the ski, the elasticity and thus the bending behaviour of the ski in its longitudinal direction remains unaffected in every respect. This attachment in a middle area can be protected against shearing forces when the ski flexes so that secure anchoring and attachment of the damping element is ensured even when the ski undergoes pronounced flexing. Trouble free damping of vertical shocks is ensured because of the fact that the carrier body is connected to the upper side of the ski in front of this middle area and behind this middle area through the interposed damping material; in particular, because of the fact that the attachment of the carrier body to the ski is effected through rigid connection of the carrier body to the upper chord of the ski, a secure and largely indestructible bond is ensured. According to a preferred development, the configuration according to the present invention can be connected to the ski such that the carrier body is arranged beneath the covering layer of the ski, and in particular beneath the decorative surface foil. In this way, the direct integration of the damping element into the design of the ski is achieved during production, which maintains the desired elasticity in the longitudinal direction and at the same time ensures a high level of protection against destruction or breakage.

In order to permit adjustment of the torsional characteristics of a ski whilst at the same time retaining the flexural elasticity in the longitudinal direction of the ski to the desired extent, the carrier body can advantageously incorporate profiles that extend transversely to the longitudinal direction of the ski, in which connection the configuration is particularly advantageous in that in the middle area the carrier body incorporates a depressed area that corresponds essentially to the thickness of the damping material and is bonded rigidly to the ski in this recessed area. Such a recessed section in the middle area permits easy connection of the carrier body to the upper chord of the ski, in which connection the damping material can be recessed, at least partially, into the surface of the ski. Such a configuration of the carrier body increases the torsional stiffness because of the rounded sections in the area of the profile recess, in which connection the torsional properties can be varied to a very great extent because of the shape and size of the transversely arranged profilings. In this kind of configuration, with a depressed central area of the carrier body that is attached to the upper chord of the ski, the design can also be such that the depressed area of the carrier body is filled with an appropriately pressure resistant filler, when it is advantageous that the rigid connection of the carrier body to the upper chord of the ski is in the form of an adhesive bond. In addition to a rigid adhesive bond of this kind, the midsection of the carrier body can be cemented and bolted to the ski, and in particular to the upper chord of the ski, in which connection this kind of screw connection does not have to absorb any shearing forces when the ski flexes.

An undivided configuration of the surface, with simultaneous and additional security of the damping elements, is ensured in that the carrier body is arranged beneath the surface covering layer, in which connection it is advantageous that the configuration be such that the carrier body be arranged in a recess in the upper side of the ski flush with the surface covering layer or foil. In order to prevent the destruction of the surface covering layer when a ski that incorporates a configuration of this kind flexes, and in order that the flexibility of the ski in the longitudinal direction is in no way restricted, it is advantageous that the surface foil be separated or cut through in front of and behind the carrier body, this being done transversely to the longitudinal direction of the ski, it being advantageous that the area of the damping plate be configured so as to be flat and without any pronounced edges, in order to avoid excessive stress at this point. To this end, it is advantageous that the configuration be such that the unattached ends of the carrier body be so configured as to form an acute angle with the ski.

It is advantageous to use carrier bodies of metal, in particular of aluminum, when, in order to improve the adhesive bond and to permit simpler machining, the configuration can be such that the carrier body is connected rigidly to the upper chord of the ski through at least one interposed layer of glass fibre reinforced plastic. In addition to connection of the carrier body to the upper chord through an interposed glass fibre reinforced plastic of this kind, the whole inner surface of the carrier body can incorporate a layer of glass fibre reinforced plastic so that, as a consequence, there is also simple adhesion to the damping material.

In order to achieve a high degree of variability with regard to torsional stability or the torsional characteristics of the ski, respectively, using simple means, it is advantageous that the configuration be such that damping elements of different hardness or stiffness be arranged adjacent to each other and transverse to the longitudinal direction of the ski, in which connection, in these cases, the damping elements that are arranged adjacent to each other in the longitudinal direction of the ski can be welded or cemented in a particularly advantageous manner to the layer of glass fibre reinforced plastic on the inner side of the carrier body.

A material with a Shore hardness of Shore A 30–90 has been found to be particularly suitable for the damping element, the thickness of the damping elements being advantageously between 2 and 12 mm.

The configuration according to the present invention permits a full range of elastic motion of the ski without restriction by the damping element and results in a rigid attachment of the carrier body and of the damping element, which cannot be detached during use, in which connection there is no danger of the carrier body or the damping element becoming loosened when the ski flexes vigorously. For reasons of stability, when skis are retrofitted with carrier bodies of this kind, for reasons of safety it is advantageous to use a screwed connection in addition to the rigid bonding that is used in the middle area, because a secure cemented joint cannot be ensured because of the problematic cleaning of the cemented surfaces. Only in the case of attachment that is effected during manufacture, during which the rigid bonding is effected directly on the upper chord of the ski is it possible to ensure a replicable and reliable bond.

It is possible to adjust the torsional characteristics by using different hardnesses in the damping elements that extend in the longitudinal direction of the ski, in which connection an additional possibility for varying the torsional stability lies in selection of the manner in which the carrier body is profiled. Glass fibre reinforced plastic on the inner side of such carrier bodies can, on the one hand, simplify good bonding, and on the other can assume the functions of reinforcing laminates, which can simultaneously increase torsional stability and reduce the danger of the bindings, which can be attached to damping elements of this sort, from tearing out.

In order to provide for more extensive adjustment of the flexibility of the carrier body and of the damping material it is preferred that the configuration be such that the damping material incorporates recesses, in particular drillings, that extend essentially transversely to the longitudinal direction of the ski, when these recesses can either remain empty or also elements, in particularly rods, of different hardnesses and flexibility characteristics can be inserted into the recesses.

In addition, prefabricated anchoring points, such as, for example, threaded sleeves or the like, can be integrated into the carrier body for the attachment of the bindings.

The present invention will be described in great detail below on the basis of the embodiments shown in the drawings appended hereto. These drawings show the following.

Figure 4:
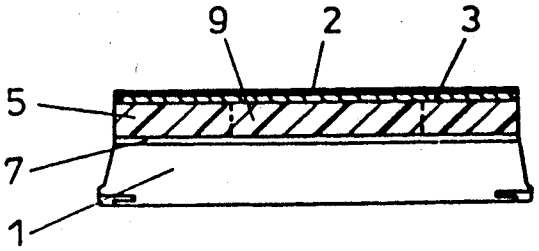
Figure 6:
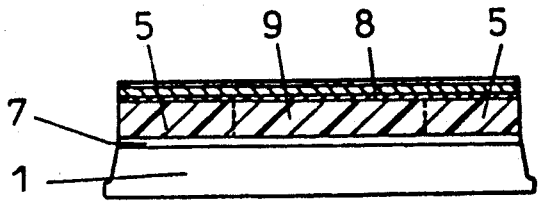
Figure 3:
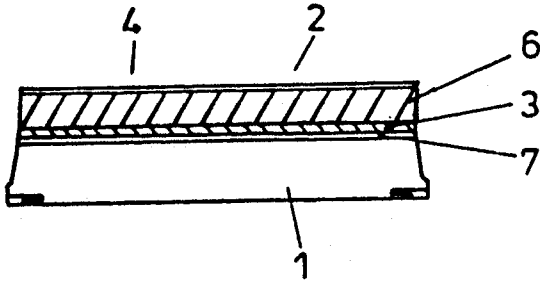
Figure 5:
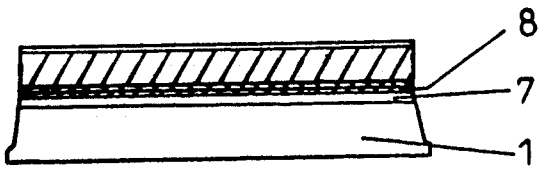
Figure 2:
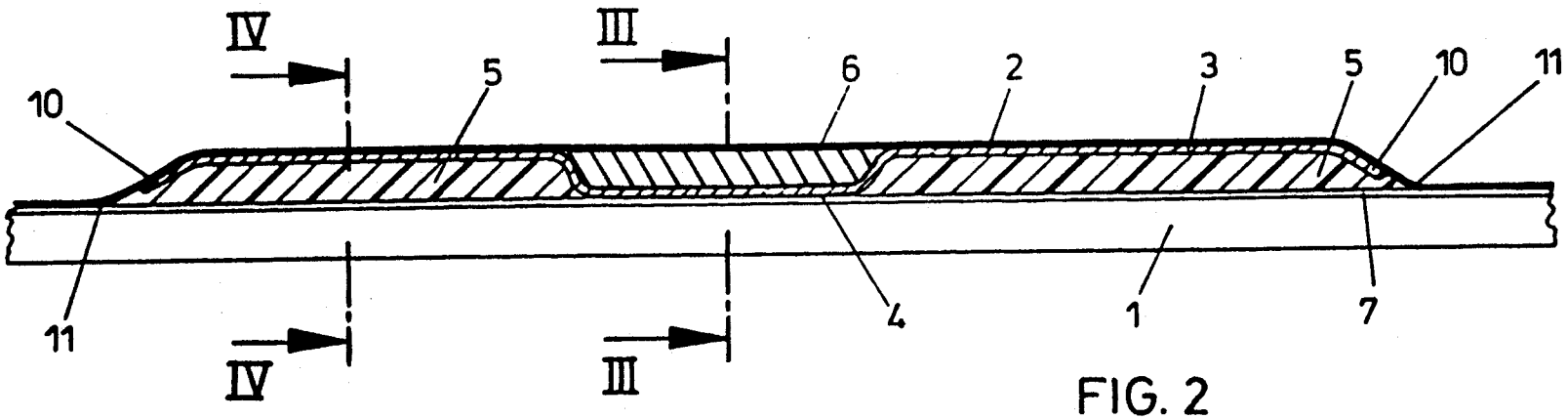
Figure 7:
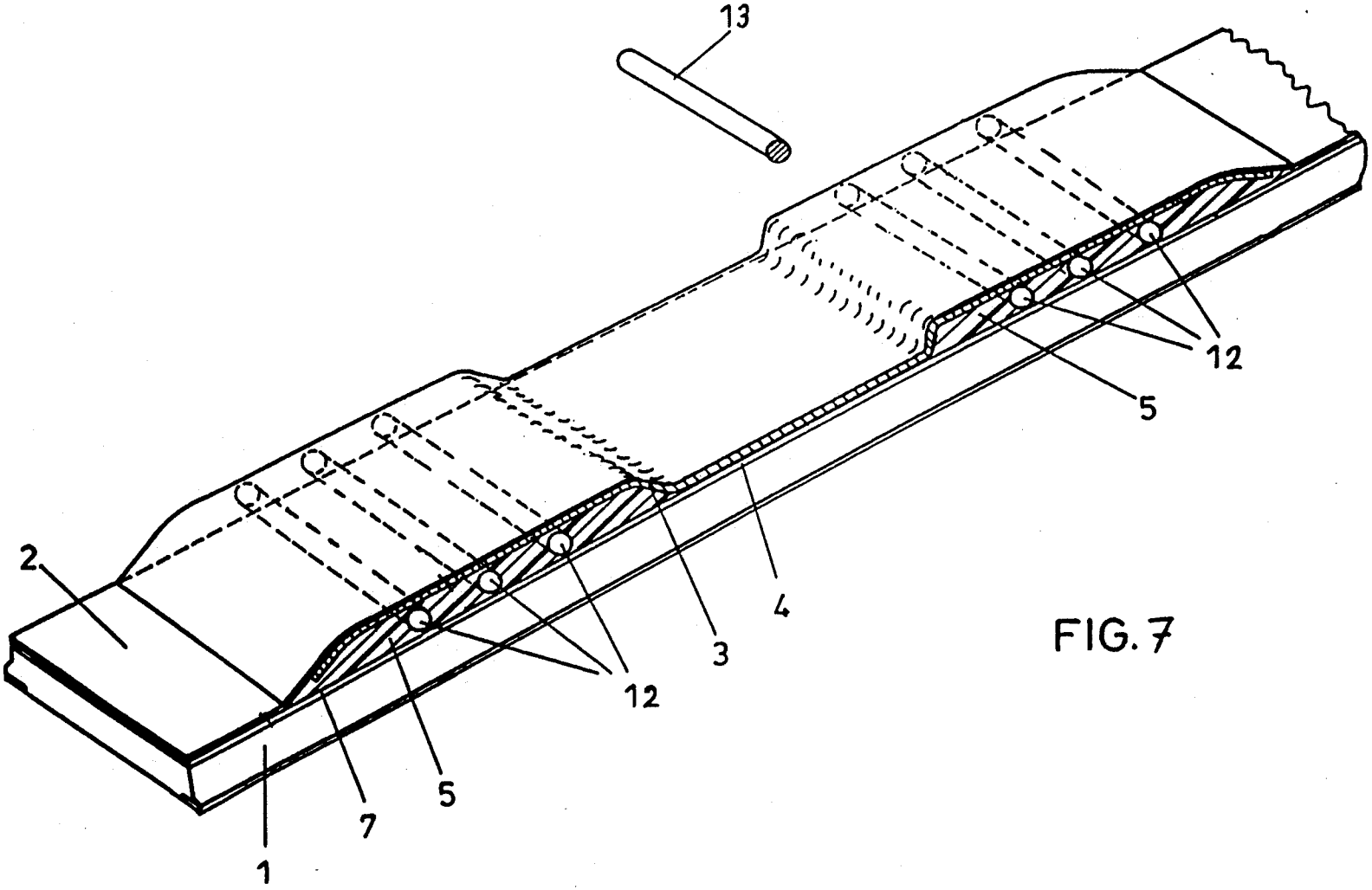

FIG. 1 A partial perspective view of a ski according to the present invention;

FIG. 2 A cross-section on the line II—II in FIG. 1;

FIG. 3 A cross-section on the line III—III in FIG. 1;

FIG. 4 A cross-section on the line IV—IV in FIG. 1;

FIG. 5 A cross-section through a modified embodiment in a view analogous to that shown in FIG. 3;

FIG. 6 A cross-section through the embodiment shown in FIG. 5 in a view analogous to FIG. 4;

FIG. 7 A view similar to FIG. 1 of a modified embodiment of a ski according to the present invention, with recesses in the damping material, to adjust the flexibility of the ski.

FIGS. 1 to 4 show a first embodiment of a ski 1, the upper side of which is covered by a surface covering layer, for example a decorative surface foil 2. In the area of a ski binding (not shown in greater detail herein) there is a carrier body 3 for damping shocks that act transversely to the longitudinal direction of the ski, this plate being, for example, of aluminum, and connected rigidly to the ski by cementing and, optionally, by additional screw connections. The areas of the carrier body 3 that are adjacent to the middle area 4 which is connected rigidly to the ski 1, are joined to the ski through interposed damping material 5, in particular an elastomer damping material. In order to provide for an essentially flat upper surface of the ski in the area of the carrier body, the recessed or lowered area 4 of the rigid bond between the carrier body and the ski 1 is filled with an appropriately pressure resistant filler 6. The depth of the lowered area of the profile that forms the carrier body corresponds essentially to the thickness of the damping material 5.

The bonding or the rigid connection of the carrier body 3 to the ski 1, and in particular with its upper chord 7, can be effected through an interposed layer of glass fibre reinforced plastic. Furthermore, in the embodiment shown in FIGS. 5 and 6, in order to provide for the simple attachment of the damping material, a continuous layer of glass fibre reinforced plastic can be provided on that surface of the carrier body 3 that is proximate to the ski 1.

In order to control the torsional characteristics of the ski 1, damping elements of various hardnesses can be arranged transversely to the longitudinal direction of the ski and adjacent to each other, as is indicated in FIGS. 4 and 6 by the outside damping elements 5 and the inside damping elements 9.

In order that they do not affect the characteristics of the ski when it flexes, the unattached ends 10 of the carrier body 3 form an acute angle with the surface of the ski 1 or of its upper chord 7 and end, when the ski is not under load, at a small distance from the surface of the upper chord 7. In order to avoid damage or destruction of the surface covering layer 2 even when there is pronounced flexing, the surface covering layer is separated or cut through immediately in front of and behind the carrying body, transversely to the longitudinal direction of the ski, as is shown diagrammatically at reference 11.

In the configuration shown in FIG. 7 there are recesses or drillings 12 incorporated in the damping material 5, these extending essentially transversely to the longitudinal direction of the ski and resulting in an increase in the elasticity of the carrier body 3 and of the damping material 5, depending on the number and arrangement used. In order to set various hardness and flexibility properties of the damping material 5, rods 13 of appropriate cross-section can be introduced into the recesses or drillings 12, respectively when, by using rods having various material properties, it is possible to obtain a match to the desired flexibility behaviour of the damping material 5.

Because of the fact that the areas 8 of the essentially plate-shaped carrier body 3 that are parallel to the upper chord of the ski and to which the binding can be attached extend at a distance from the surface of the ski or from the upper chord 7 of the ski, and even during flexing there is no direct contact of the areas 8 on the chord of the ski, it is possible to decouple the oscillatory behaviour of the ski and of the binding, so that blows or shocks to the ski can be intercepted completely by the damping elements and not transmitted to the binding or to the skier's foot. When curved carrier bodies are used there is also the added advantage of a greater distance between the ski boot clip and, in particular, the sole of the ski boot from the lower edge of the ski and thus greater ground clearance, which is of particular advantage when the ski edges are used and short radius turns are made. Furthermore, within the depressed area 4 of the carrier body there is also room to incorporate various additional devices such as, for example, a lockable ski brake, lockable binding elements, an odometer, or electronic binding controls.

I claim:

1. A ski having front and rear ends, with a damping element to damp out shocks that act transversely to a longitudinal direction of the ski in an area adjacent that of a ski binding, comprising:

a carrier body;

at least one layer of damping material which is arranged between the carrier body and the ski, said damping material comprising an elastomer; and said carrier body being bonded rigidly to an upper chord of the ski in a middle area which lies between front and rear ends of said carrier body in the longitudinal direction of the ski, said carrier body being connected in front of and behind said middle area to the surface of the ski through said damping material.

2. A ski as defined in claim 1, wherein said carrier body is arranged beneath a ski covering layer.

3. A ski as defined in claim 2, wherein said carrier body is arranged beneath said ski covering layer.

4. A ski as defined in claim 1, wherein said carrier body is rigidly bonded to the upper chord of the ski by a cement bond.

5. A ski as defined in claim 1, wherein said carrier body has unattached ends which form an acute angle with the ski.

6. A ski as defined in claim 1, wherein said carrier body is rigidly connected to the upper chord of the ski through an interposed layer of glass fibre reinforced plastic.

7. A ski as defined in claim 1, wherein said carrier body is metal.

8. A ski as defined in claim 1, wherein said carrier body is arranged in a recess in an upper side of the ski so as to be flush with a surface of a covering layer.

9. A ski as defined in claim 8, wherein said surface covering layer is cut through or separated transversely to the longitudinal direction of the ski, both in front of and behind the carrier body.

10. A ski as defined in claim 1, wherein damping materials of various hardnesses or stiffness are arranged transversely to the longitudinal direction of the ski and adjacent to each other in the longitudinal direction of the ski.

11. A ski as defined in claim 1, wherein said carrier body incorporates profiling that extends transversely to the longitudinal direction of the ski.

12. A ski as defined in claim 1, wherein said damping material that is used has a Shore hardness (A) of 30 to 90.

13. A ski as defined in claim 1, wherein said damping material amounts to 2–12 mm measured perpendicularly to the surface of the ski.

14. A ski as defined in claim 1, wherein said damping material incorporates recesses which are essentially transverse to the longitudinal direction of the ski.

15. A ski as defined in claim 14, wherein a plurality of different material rods are introduced into said recesses, said different materials varying the flexibility characteristics of the damping material.

16. A ski as defined in claim 1, wherein said carrier body is aluminum.

17. A ski with a damping element to damp out shocks that act transversely to a longitudinal direction of the ski in an area adjacent that of a ski binding, comprising:

a carrier body;

at least one layer of damping material which is arranged between the carrier body and the ski, and wherein the carrier body is bonded rigidly to an upper chord of the ski in a middle area that lies between a front end and a rear end of the ski; and said middle area of the carrier body has a depressed area which corresponds essentially to the thickness of the damping material and is bonded rigidly to the ski in the depressed area.

18. A ski with a damping element to damp out shocks that act transversely to a longitudinal direction of the ski in an area adjacent that of a ski binding, comprising:

a carrier body;

at least one layer of damping material which is arranged between the carrier body and the ski, and wherein the carrier body is bonded rigidly to an upper chord of the ski in a middle area that lies between a front end and a rear end of the ski in the longitudinal direction; and the middle area has a depressed area which corresponds essentially to the thickness of the damping material, said depressed area of the carrier body is filled with a pressure resistant filler.

19. A ski with a damping element to damp out shocks that act transversely to a longitudinal direction of the ski in an area adjacent that of a ski binding, comprising:

a carrier body;

at least one layer of damping material which is arranged between the carrier body and the ski, and wherein the carrier body is bonded rigidly to an upper chord of the ski in a middle area that lies between a front end and a rear end of the ski in the longitudinal direction; and wherein said carrier body incorporates at least one layer of glass fiber reinforced plastic on an inner side which is adjacent to the ski.

20. A ski with a damping element to damp out shocks that act transversely to a longitudinal direction of the ski in an area adjacent that of a ski binding, comprising:

a carrier body;

at least one layer of damping material which is arranged between the carrier body and the ski, and wherein the carrier body is bonded rigidly to an upper chord of the ski in a middle area that lies between a front end and a rear end of the carrier body in the longitudinal direction of the ski; and wherein said middle area of the carrier body is bonded and screwed to the ski.

* * * * *